United States Patent [19]

Bigo et al.

[11] Patent Number: 4,469,012

[45] Date of Patent: Sep. 4, 1984

[54] PRESSURIZED FLUID MECHANISM COMPRISING REACTION ROLLERS MOUNTED ON PISTONS

[75] Inventors: Louis B. Bigo, Compiegne; Patrick E. Ramousse, Lacroix-Saint-Ouen, both of France

[73] Assignee: Poclain Hydraulics, France

[21] Appl. No.: 370,745

[22] Filed: Apr. 22, 1982

[30] Foreign Application Priority Data

May 4, 1981 [FR] France ..... 81 08786

[51] Int. Cl.[3] ..... F04B 13/06

[52] U.S. Cl. ..... 91/491

[58] Field of Search ..... 91/491, 492, 497

[56] References Cited

U.S. PATENT DOCUMENTS 3,165,068 1/1965 Burnham et al. ..... 91/492
4,256,018 3/1981 Badoureaux ..... 91/491

FOREIGN PATENT DOCUMENTS 762233 7/1967 Canada ..... 91/497
2262776 7/1973 Fed. Rep. of Germany ..... 91/491
23805 7/1965 Japan ..... 91/491
1220146 1/1971 United Kingdom ..... 91/491
1299442 12/1972 United Kingdom ..... 91/492

*Primary Examiner*—William L. Freeh
*Attorney, Agent, or Firm*—Lewis H. Eslinger

[57] ABSTRACT

The invention relates to a pressurized fluid mechanism comprising a cam, a cylinder-block mounted for rotation with respect to the cam, cylinders disposed radially in said cylinder-block, pistons sliding in said cylinders, supporting rollers supporting the pistons on said cam, each roller being placed inside a transverse bore provided in each piston and a device with abutments to hold each roller in axial position in its bore.

Each roller being able to comprise two projecting members on each side, the abutments present interruptions in axial directions which coincide with the radial planes containing said projecting members.

The invention finds an application in the production of compact engines with "releasable" pistons.

5 Claims, 16 Drawing Figures

Fig. 1
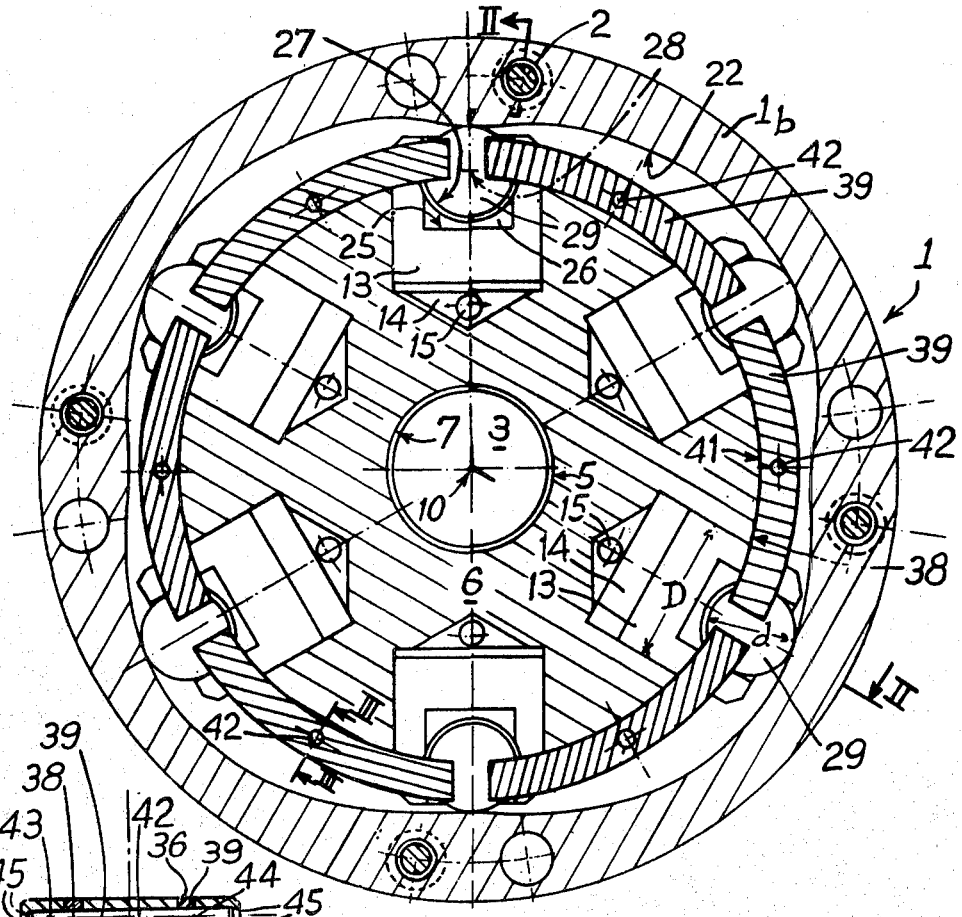
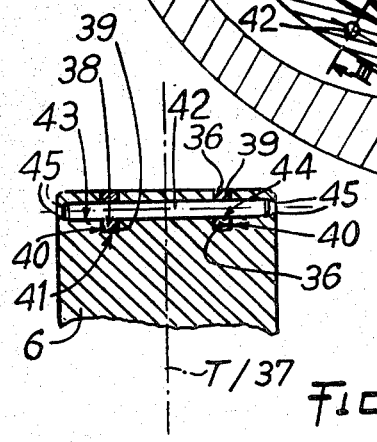
Fig. 3

Fig. 4
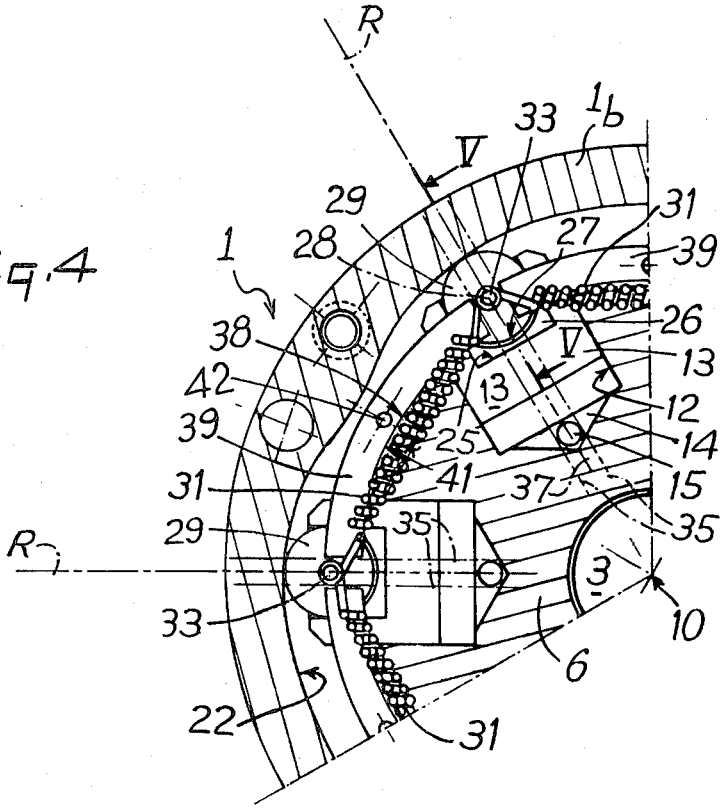
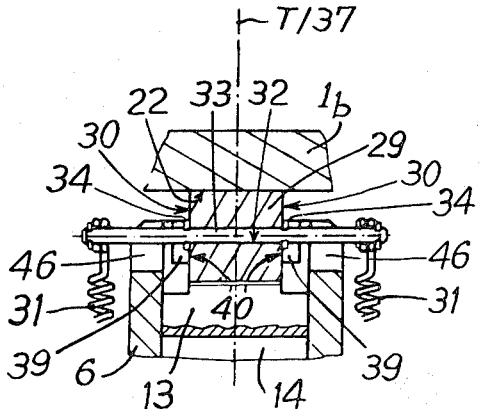
Fig. 5

Fig. 6
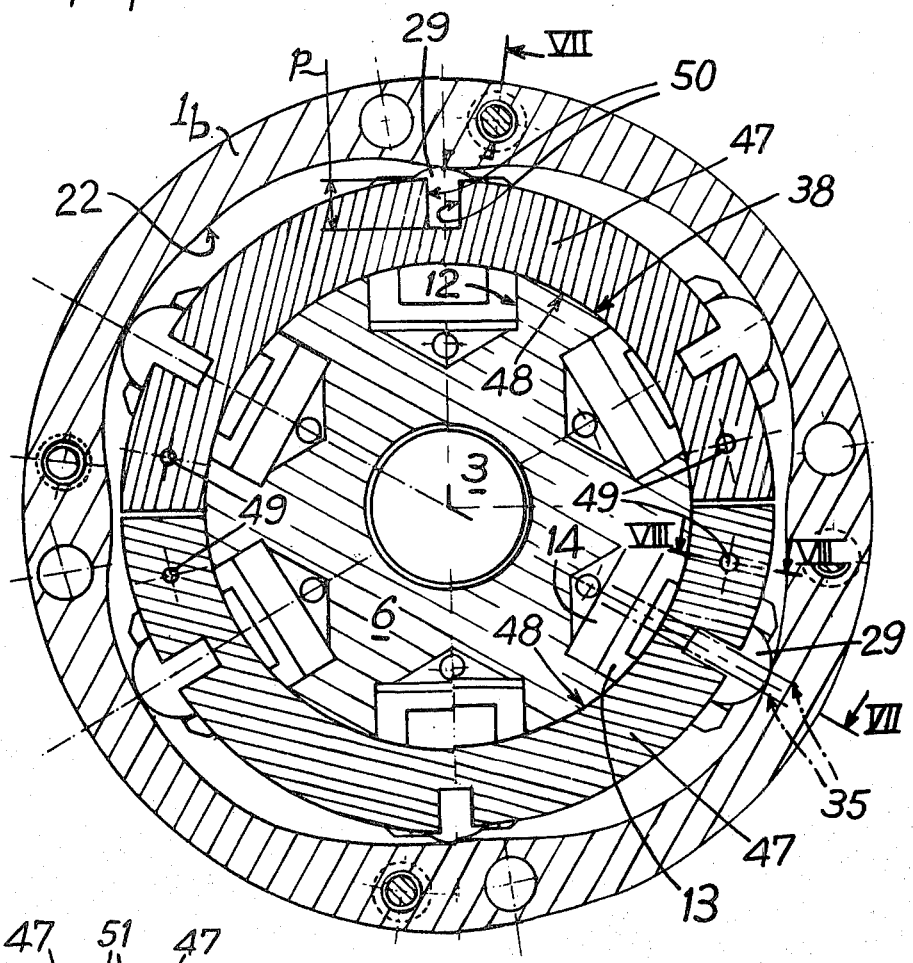
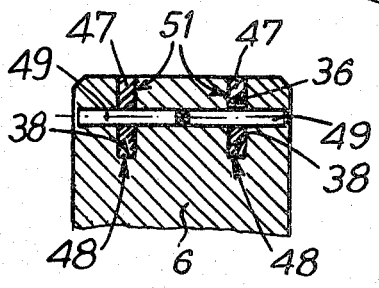
Fig. 8

Fig. 11
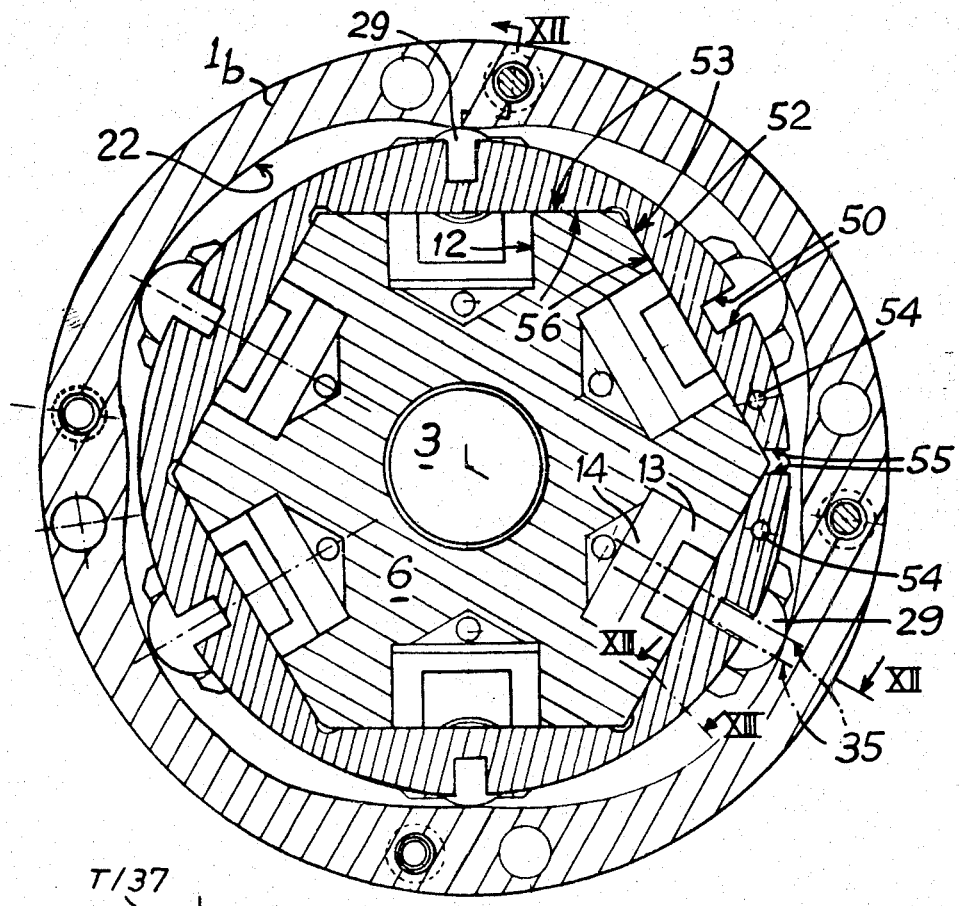
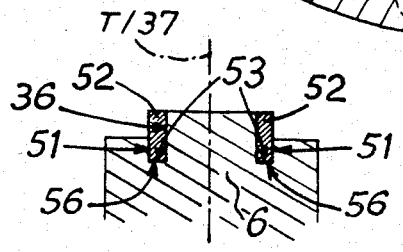
Fig. 13

Fig. 14
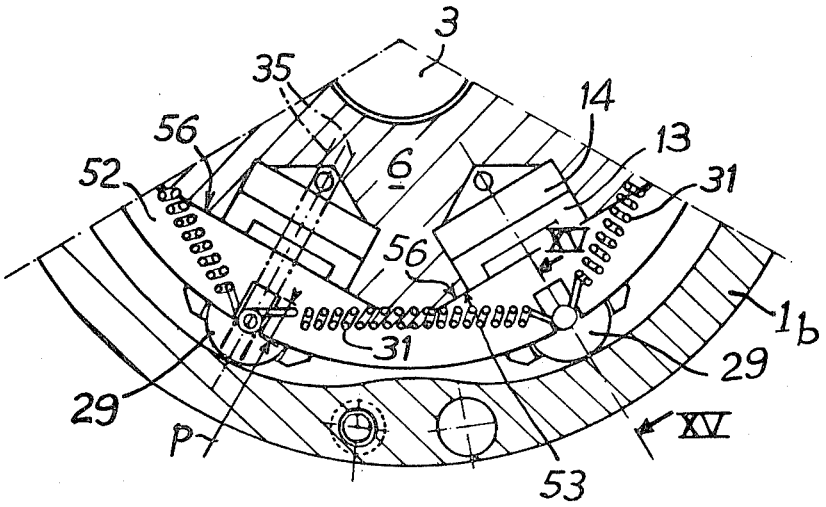
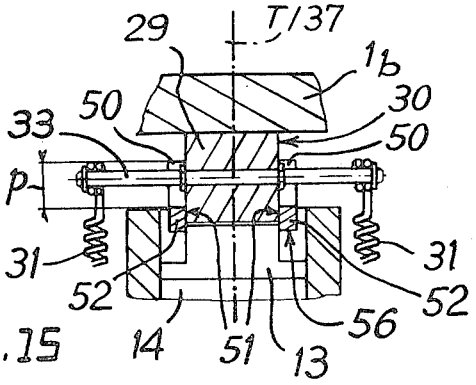
Fig. 15

PRESSURIZED FLUID MECHANISM COMPRISING REACTION ROLLERS MOUNTED ON PISTONS

Hydraulic motors are already known which comprise pistons resting on a reaction cam by means of rollers mounted for rotating on the pistons proper. Said rollers need to be axially held in position on the corresponding pistons.

It is the object of the present invention to propose new means for holding the rollers axially in position on the pistons, which means are especially applicable to piston engines known as "releasable", of which the pistons, not being fed with pressurized fluid, need to be held retracted in the cylinders.

The invention more generally relates to a pressurized fluid mechanism, such as a hydraulic engine or pump, comprising:

a body supporting at least a cam, a cylinder-block mounted for rotating about an axis with respect to the said body, a plurality of cylinders placed radially with respect to the said axis of rotation of the cylinder-block, pistons mounted for sliding inside cylinders, one piston per cylinder, cylindrical rollers through which the pistons rest on the cam or cams, of axis parallel to the rotation axis of the block-cylinder, each placed in at least part of a transverse bore provided in each piston, and, means for holding each roller in axial position inside its bore, which means are constituted by abutments mounted on the cylinder-block, and on which the end edges of the rollers can rest.

Each roller is adapted to comprise two co-axial projecting members placed on each side of said roller, whereas the said abutments present at least partial interruptions in radial directions, which coincide with the radial planes containing the said projecting members, so as to allow the radial spring-back clearance of these projecting members concomittently to the sliding of the piston.

The following advantageous dispositions are also preferably adopted;

the abutments are constituted by a plurality of uniform sectorial elements, each one extending between the projecting members situated on one side of the plane containing the axes of the cylinders, which members may be provided on two successive rollers, which are secured on the cylinder-block by at least one securing pin, or similar element;

according to another embodiment, the abutments are constituted by at least two sectorial elements, each one extending over an angular sector greater than that separating the axes of two consecutive cylinders, which sectorial elements are provided with indentations which coincide with the portions of radial slot provided for the spring-back clearance of the projecting members which, at least some of the rollers, can comprise, and, which are fixed on the cylinder-block by at least one securing pin, or the like;

one part at least of the peripheral faces of the portions of cylinder-block separating adjacent cylinders are shaped to correspond with the faces of the said sectorial elements which are directed towards the axis of rotation and constitute supporting faces for said sectorial elements on the cylinder-block, preventing the rotation of the latter about said "at least one pin";

according to a third embodiment, on one side at least of a transverse plane containing the axes of several cylinders, the abutments are constituted by a single ring, which is provided with an opening and is capable of withstanding a deformation setting its ends apart, which ends define said opening, so as to be fitted around the cylinder-block by way of said elastic deformation, the said ring being also provided with indentations which coincide with the radial slot portions provided for the spring-back clearance of the projecting members, which at least some of the rollers can comprise;

at least part of the peripheral face of the cylinder-block which is situated opposite the said ring has an outline with a revolving asymmetry and is shaped to correspond to the face of that ring placed opposite, so that the ring is held fast in rotation with the cylinder-block;

two securing pins, or the like, secure the opening ends of the ring on the cylinder-block;

said securing pin or pins or the like, are held back in their recesses by forcing back the material delimiting the opening of said recesses;

the mechanism effectively comprises rollers provided with projecting members, springs being coupled to the projecting members of separate rollers in order to allow the retraction of the corresponding pistons inside their cylinders during one operation of the mechanism when these cylinders contain no pressurized fluid.

The invention will be more readily understood on reading the following description, with reference to the accompanying drawings in which:

FIG. 1 is a cross-section, along line I—I of FIG. 2 of a hydraulic motor according to a first embodiment of the invention;

FIG. 3 is a cross-section along line III—III of FIG. 1;

FIG. 4 is a partial cross-section, similar to that shown in FIG. 1, of a variant embodiment according to the invention of the engine shown in FIG. 1;

FIG. 5 is a cross-section along line V—V of FIG. 4;

FIG. 6 is a cross-section, along line VI—VI of FIG. 7, of a hydraulic engine according to the second embodiment of the invention;

FIG. 8 is a cross-section along line VIII—VIII of FIG. 6;

FIG. 11 is a cross-sectional view along line XI—XI of FIG. 12, of a hydraulic engine according to a third embodiment of the invention;

FIG. 13 is a cross-section along line XIII—XIII of FIG. 11;

FIG. 14 shows part of a cross-section similar to that shown in FIG. 11, of a variant according to the invention, of the engine; and, FIG. 15 is a cross-section along line XV—XV of FIG. 14.

Figure 2:
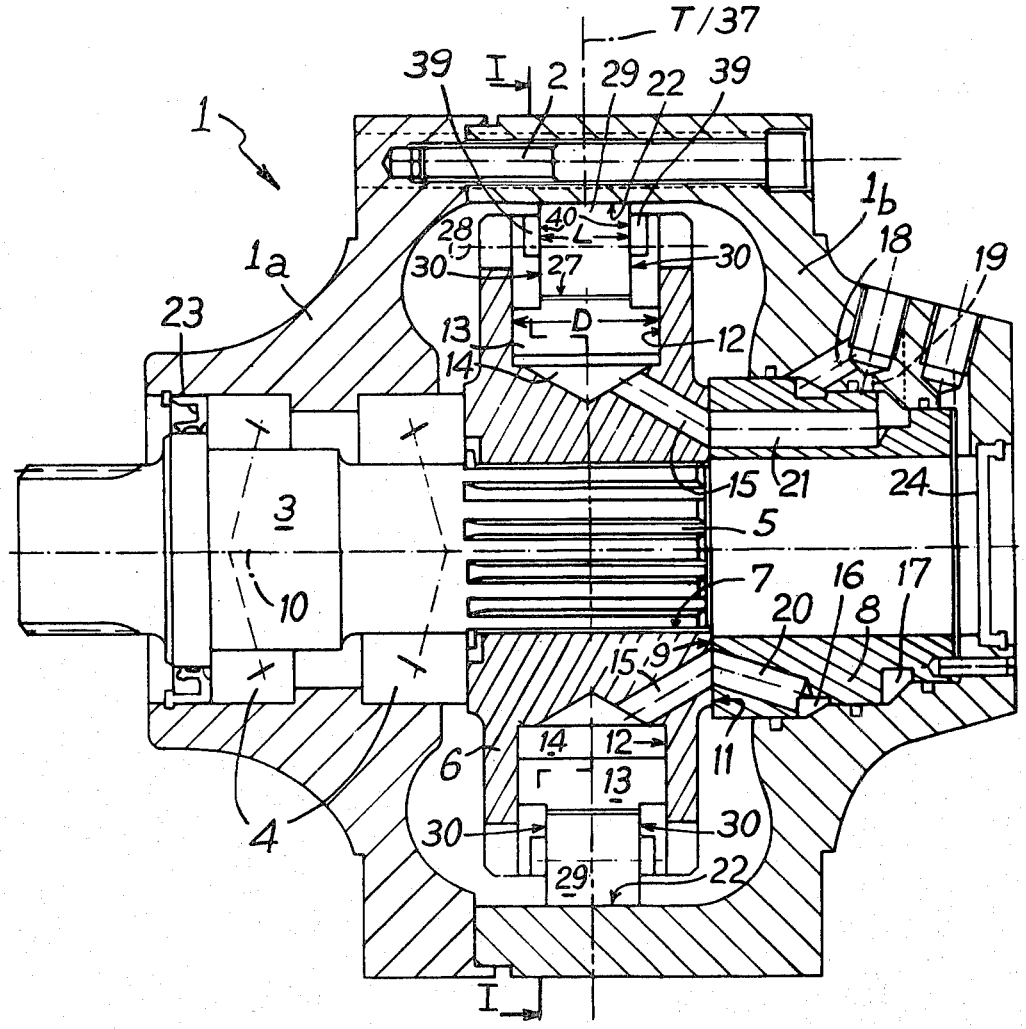
FIG. 2 is an axial section along line II—II of FIG. 1.

The different hydraulic motors illustrated in the drawings, and their variants, all have common characteristics of structure as well as other characteristics which are particular to each engine.

The structure common to all the illustrated engines consists of:

a casing 1 in two parts 1*a* and 1*b* assembled together by screws 2, a driving shaft 3, mounted for rotation with respect to the casing 1 by means of taper roller bearings, and provided with splines 5, a cylinder-block 6, also provided with splines 7 meshing with the splines 5 of the driving shaft 3, a fluid-control valve-seat 8, which is plane and of which one face 9 perpendicular to the rotation axis 10 of the driving shaft rests against an equally plane transversal face 11 of the cylinder-block 6, cylinders 12 provided in the cylinder-block 6 and disposed radially, pistons 13, mounted for sliding in said cylinders 12, one in each cylinder, chambers 14, defined inside the cylinders by the pistons 13 each one communicating with the face 11 of the cylinder-block via a conduit 15, two grooves 16 and 17, provided on the periphery of the valve-seat 8 and which are connected, on the one hand, via conduits 18 and 19, provided in the part 1*b* of the casing, with external conduits for supplying pressurized fluid and returning the fluid to a non-pressurized reservoir, and on the other hand, with the face 9 of the valve-seat 8 via conduits 20, 21 issuing alternately in each conduit 15 of the chambers 14, a cam 22 which is constituted by the peripheral inner face of part 1*b* of the casing and which comprises several undulations, a seal 23, placed between the driving shaft 3 and the part 1*a* of the casing, and, a tight cover 24, which is mounted on the part 1*b* of the casing and completes the said casing 1, making it into a tight enclosure protected from external pollution.

Each piston 13 comprises a parallelepipedal cavity 25 situated opposite the corresponding chamber 14 and issuing towards the outside, so as to receive a support 26 of a partial circular cylindrical bearing 27 of axis 28 parallel to the axis 10 of the driving shaft 3. Said bearing 27 achieves the rotary assembly, over an axial length L shorter than the diameter D of the piston 13, of an equally cylindrical roller 29 of the same length, and with circular section. Said roller 29, of diameter d less than the diameter D of the piston 13, on the one hand, has dimensions which enable it to penetrate at least partly inside the cylinder 12, and on the other hand, is in rolling support on the cam 22. Moreover, all these rollers 29 of one engine are held in position inside their bearings 27 in the direction of axes 28 of said bearings, by elements forming axial abutments for the outermost transverse faces 30 of said rollers, which are secured on the cylinder-block 3, which rollers can be produced according to several separate embodiments, some of which are given hereunder.

Before describing each embodiment, the functions and constitutions of the rollers 29 should first be specified. Said rollers 29 have the main function of transferring the thrust between the reaction cam 22 and the pistons 13. According to the main embodiments illustrated in FIGS. 1, 2, 3 or 6, 7, 8, or else, 11, 12, 13, the rollers 29 only have that one function as main function; on the contrary, according to the respective variants of said main embodiments, illustrated in FIGS. 4, 5 or 9, 10, or else, 14, 15, the rollers have a second function, which consists in constituting attaching points for springs 31. To this effect, each roller 29 is provided with an axial bore 32 to allow a spindle 33 through, which spindle projects with respect to each transverse face 30 of said roller, and is held in position inside the bore 32 by means of stops 34, its ends constituting anchoring supports for springs 31, at least one spring stretched between the rollers corresponding to the pistons 13 sliding in two successive cylinders 12. It is to be noted that, when the pistons are sliding inside the cylinders, the ends of the spindles 33 can move with respect to the cylinder-block 6, inside radial strips or slots defined by two parallel planes 35 placed symmetrically with respect to the radial plane R passing through the axis 37 of each cylinder 12. It is understood that, as is already known, the springs 31 enable, in certain modes of operation of the engines, to hold the pistons 13 in a retracted position inside the cylinders 12, in an equally known configuration which is that of the "pistons release". All the engines do not have such a possibility of "releasing their pistons", and are then provided with simple rollers, with no spindles 33: this is especially the case with the engines in the aforesaid main embodiments.

These dispositions, some of which are found in all the engines, whilst the others are only found in the engines according to the main embodiments or according to variants thereof, will now be described together with the dispositions particular to each main embodiment and to its associated variant.

According to the embodiment illustrated in FIGS. 1, 2, 3 and in FIGS. 4 and 5, the corresponding engines have their cylinder-block 6 equipped with two parallel grooves, disposed symmetrically with respect to the transverse plane T traversing the axes 37 of the cylinders, and perpendicular to the rotation axis 10. Said grooves issue on the external periphery of the cylinder-block, and are each defined by two faces 36 parallel to the plane T and by a cylindrical face 38 of axis 10. Between the radial slots (defined by the planes 35) relative to the spindles 33 of two successive rollers 26, segments 39 are introduced in the grooves 36–38. Their ends project inside cylinders 12 so as to be permanently facing the outermost transverse faces 30 of the rollers 29 and to constitute axial abutments holding the rollers 29 in position. The ends of said segments 39 are moreover disposed outside the radial slots defined by the planes 35. It is further observed that the shape of the segments 39 correspond to the shape of the grooves 36–38, that of the edges 40 of said segments corresponding to that of the faces 36, and that of the cylindrical inner face of said segments corresponding to that of the circular cylindrical face 38 with which it is in contact. Moreover, a pin 42 traverses holes 43 and 44 provided in the cylinder-block 6 and the segments 39 respectively completing the anchoring of each segment 39 in the corresponding groove. Finally, each pin 42 is held in position by forcing back (45) the material defining the external orifices of the holes 43 of the cylinder-block. In the variant illustrated in FIGS. 4 and 5, the cylinder-block 6 is further provided with transversal grooves 46, symmetrical with respect to the planes R of the different cylinders, to allow the spring-back clearance of the spindles 33.

Figure 7:
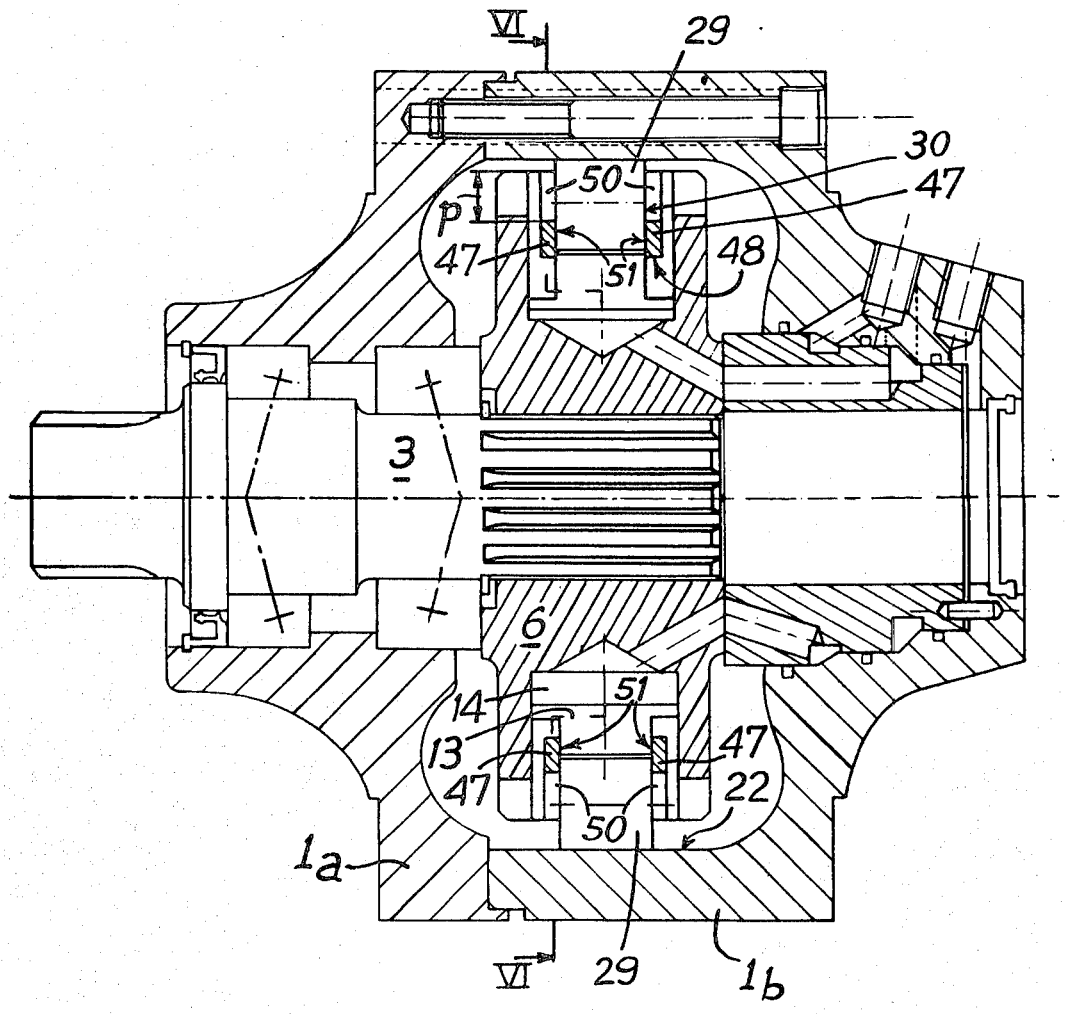
FIG. 7 is an axial section along line VII—VII of FIG. 6.
Figure 9:
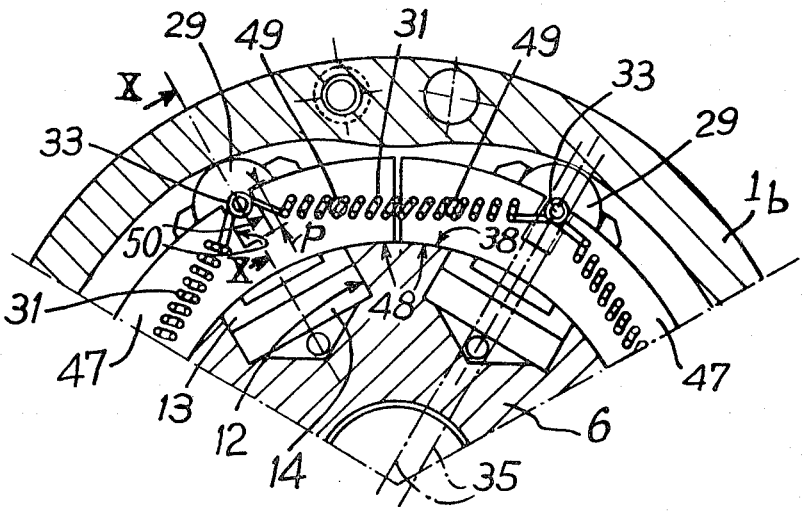
FIG. 9 is a partial cross-section, similar to that shown in FIG. 6, of a variant according to the invention of the engine shown in FIG. 6.
Figure 10:
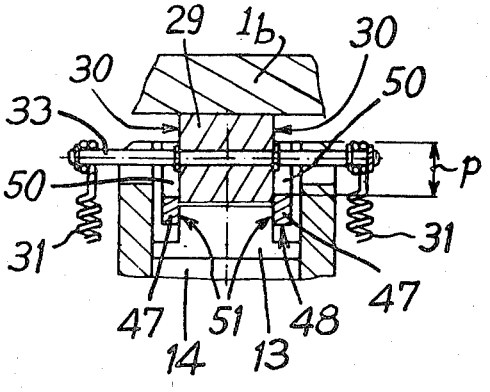
FIG. 10 is a cross-section along line X—X of FIG. 9.

According to the embodiment illustrated in FIGS. 6, 7, 8 and in FIGS. 9 and 10, the constitution of the engines shown therein resembles that of the previous motors, with the exception of the embodiment of the segments into two elements 47 only, each of which two elements extend necessarily over an angular sector larger than that previously included between two radial slots (35), and actually, over a sector of about 180°. The two grooves (36–38) in which are placed the segment 47 are also found, the cylindrical inner faces 48 of said segments being in contact with the cylindrical circular faces 38 of said grooves. The anchoring of each segment is completed by two pins 49 placed close to the ends of the segment. Room for free spring-back clearance should be given to the ends of the spindles 33 of the rollers 29, and to this effect, grooves 50 are provided in each segment, in the areas where said segment traverses the different cylinders 12, each groove 50 going slightly over the planes 35 limiting the spring-back clearance of the ends of the spindles 33, and having a sufficient depth p to allow the maximum spring-back clearance of said spindles 33. Obviously, the transverse faces 51 of the segments 47 constitute, in the area where they traverse the different cylinders, abutments for holding the rollers 29 in an axial position.

Figure 12:
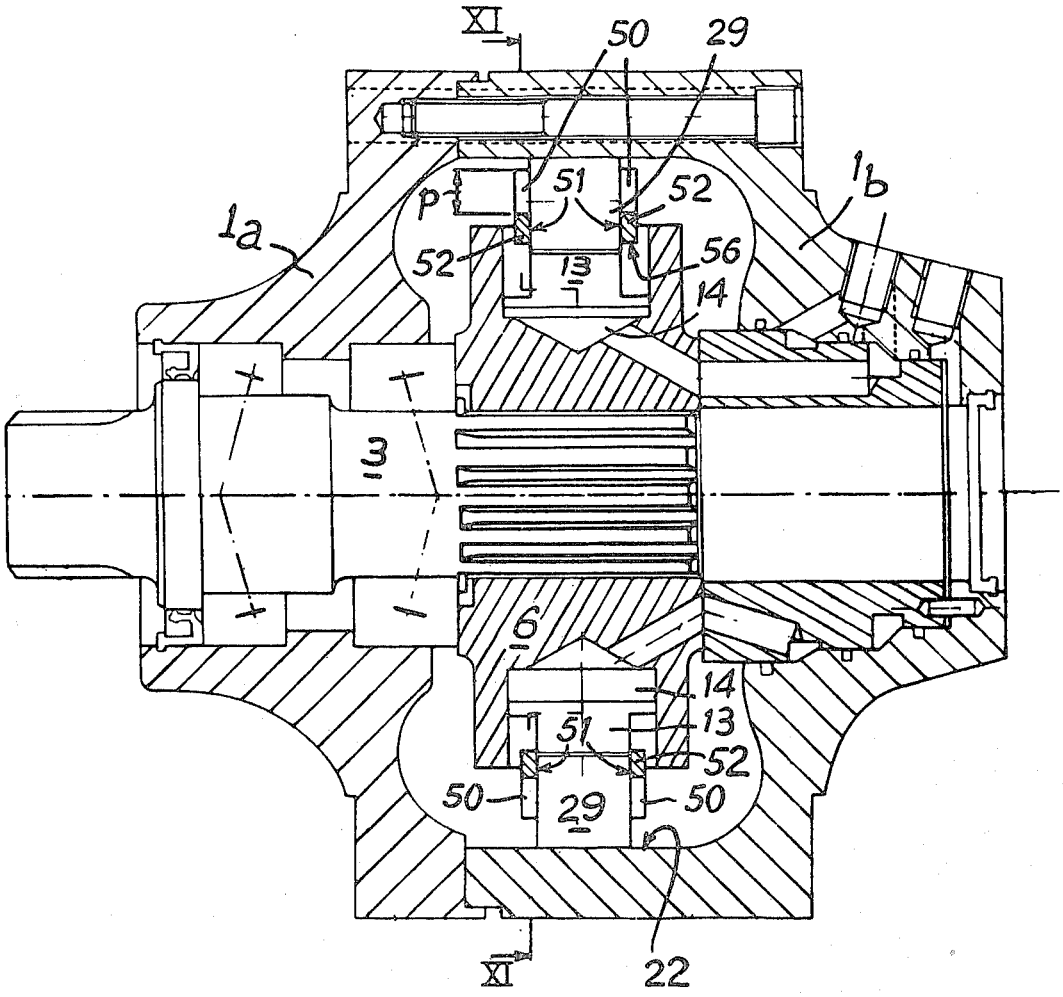
FIG. 12 is a cross-section along line XII—XII of FIG. 11.

According to the embodiments illustrated in FIGS. 11, 12, 13 and in FIGS. 14 and 15, only one segment 52 is provided on each side of the plane T. Moreover, each groove is defined by, on the one hand, two transverse faces 36, perpendicular to the axis of rotation 10, and on the other hand, a polygonal face, constituting the bottom of the groove. Two pins 54 are provided to hold in a closed up position the ends 55 of the ring provided with an opening, constituted by each segment 52. The grooves 50 and faces 51 already defined in the constitution of segments 47 of the previous embodiment, are also found in this one, with the same characteristics and functions. It is to be further noted that the contact of the polygonal inner face 56 of the segment 52 with the polygonal face 53, as well as the elastic deformability of the segments 52 allow them by resiliently setting the ends 55 apart, to be fitted in the grooves of the cylinder-block 6.

In each one of the illustrated embodiments, the transverse faces (40, 51) of the segments hold the rollers 39 in axial position inside their housings.

Moreover, whether or not the engine is equipped with "releasable pistons", its structure is the same, and it is possible, without changing anything therein, except of course adopting rollers 29 equipped with spindles 33 and springs 31, to produce an engine with "releasable pistons" from the common structure. The interruptions of the segments 39 in the area of the planes 35, or the grooves 50 of the segments 47, 52 enable the spring-back clearance of the spindles 33 with which some rollers may be equipped.

Also, the complementary shapes of the segments 39 and 47 of the grooves containing them, prevent the rotation of these segments around pins 42 and 49 respectively.

And also, in the embodiment shown in FIGS. 11 to 15, the cooperation of the polygonal shapes of the faces 53 and 56 naturally holds the segments 52 in position on the cylinder-block 6 without pins being needed to prevent the rotation of the segments about the axis 10.

The invention is in no way limited to the embodiments described hereinabove and on the contrary covers any modifications that can be made thereto without departing from the scope or the spirit thereof.

What is claimed is:

1. A pressurized fluid mechanism comprising:

a body supporting at least one cam;

a cylinder block mounted on said body for rotation about an axis of rotation with respect to said body;

a plurality of cylinders disposed within said cylinder block radially with respect to said axis of rotation of said cylinder block;

a plurality of pistons each mounted within a respective one of said cylinders for movement relative to the respective cylinder in a direction radially in respect to said axis of rotation;

cylindrical rollers respectively mounted upon said pistons and engageable with said at least one cam, said rollers having axes parallel to said axis of rotation of the cylinder block, each of said pistons having a transverse bore, and each cylindrical roller being disposed in at least part of said bore in the respective one of said pistons; and means for holding each roller in axial position in the respective bore including abutments on said cylinder block engageable with end edges of said rollers, two coaxial projecting members on opposite sides of each of said rollers and moving radially with the respective one of said pistons, said abutments having interruptions extending at least partially therethrough in the radial direction and aligned with paths of radial movements of said projecting members with the respective pistons for permitting said radial motion of said pistons, said abutments being constituted by a single split ring on at least one side of a transverse plane containing the axes of several of said cylinders, said single split ring defining an opening between its ends and being elastically deformable by urging said ends apart so as to fit around said cylinder block, and indentations in said ring to coincide with said radial interruptions provided for the clearance of said projecting members of at least a plurality of said rollers.

2. Mechanism according to claim 1, wherein at least part of the peripheral face of the cylinder-block which is situated opposite the said ring has an outline with a revolving asymmetry and is shaped to correspond to the face of that ring placed opposite, so that the ring is held fast in rotation with the cylinder-block.

3. Mechanism according to claim 1, wherein said mechanism further includes springs coupled between the projecting members of separate rollers in order to allow the retraction of the corresponding pistons inside their cylinders during an operation of the mechanism when the cylinders contain no pressurized fluid.

4. Mechanism according to claim 1, wherein securing pins secure said ends of the ring on the cylinder block.

5. Mechanism according to claim 4, wherein said securing pins are held in respective recesses by forcing back the material delimiting openings of said recesses.

* * * * *